US006770614B2

(12) United States Patent
Miller et al.

(10) Patent No.: US 6,770,614 B2
(45) Date of Patent: Aug. 3, 2004

(54) CLEANER FOR ELECTRONIC PARTS AND METHOD FOR USING THE SAME

(75) Inventors: Richard L. Miller, Doylestown, PA (US); Melodee A. Nemeth, Newark, DE (US)

(73) Assignee: CRC Industries, Inc., Warminster, PA (US)

( * ) Notice: Subject to any disclaimer, the term of this patent is extended or adjusted under 35 U.S.C. 154(b) by 241 days.

(21) Appl. No.: 10/161,018

(22) Filed: Jun. 3, 2002

(65) Prior Publication Data

US 2003/0224956 A1 Dec. 4, 2003

(51) Int. Cl.[7] ..... C11D 7/50; C11D 7/30; C23G 5/28

(52) U.S. Cl. ..... 510/411; 510/177; 510/273; 510/410; 252/67; 252/364; 134/38; 134/40

(58) Field of Search ..... 510/411, 177, 510/273, 410; 252/364, 67; 134/38, 40, 12

(56) References Cited

U.S. PATENT DOCUMENTS

| | | | | |
|---|---|---|---|---|
| 4,999,127 | A | 3/1991 | Merchant | |
| 5,250,208 | A | 10/1993 | Merchant et al. | |
| 5,552,080 | A | 9/1996 | Bolmer | |
| 5,605,882 | A | 2/1997 | Klug et al. | |
| 5,648,016 | A | 7/1997 | Klug et al. | |
| 5,654,129 | A | 8/1997 | Taylor | |
| 5,750,488 | A * | 5/1998 | Haskell et al. | 510/412 |
| 5,779,931 | A | 7/1998 | Klug et al. | |
| 5,827,446 | A | 10/1998 | Merchant et al. | |
| 5,851,436 | A | 12/1998 | Merchant et al. | |
| 5,902,412 | A | 5/1999 | Taylor | |
| 5,962,390 | A | 10/1999 | Flynn et al. | |
| 5,965,511 | A * | 10/1999 | Michaud et al. | 510/408 |
| 6,100,229 | A | 8/2000 | Swan et al. | |
| 6,159,917 | A | 12/2000 | Baran, Jr. et al. | |
| 6,197,426 | B1 | 3/2001 | Coppens | |
| 6,235,700 | B1 | 5/2001 | Flynn et al. | |
| 6,255,273 | B1 | 7/2001 | Musso et al. | |
| 6,274,543 | B1 | 8/2001 | Milbrath et al. | |
| 6,281,184 | B1 * | 8/2001 | Michaud et al. | 510/410 |
| 6,288,017 | B1 | 9/2001 | Flynn et al. | |
| 6,291,417 | B1 | 9/2001 | Flynn et al. | |
| 6,699,829 | B2 * | 3/2004 | Doyel et al. | 510/410 |
| 2001/0018408 | A1 | 8/2001 | Flynn et al. | |
| 2001/0044404 | A1 | 11/2001 | Flynn et al. | |

OTHER PUBLICATIONS

ACGIH, "Threshold Limit Values (TLVs) for Chemical Substances and Physical Agents and Biological Exposure Indices (BEIs)", Documentation of the Threshold Limit Valves and Biological Exposure Indices, pp. 44–47, (1995).

* cited by examiner

*Primary Examiner*—Gregory Webb
(74) *Attorney, Agent, or Firm*—Akin Gump Strauss Hauer & Feld, LLP

(57) ABSTRACT

Precision cleaning compositions for electronic and electrical components comprise at least one halogenated, saturated or unsaturated hydrocarbon other than cis-1,2-dichloroethylene; at least one fluorinated saturated or unsaturated hydrocarbon having the formula $C_nH_mF_p$, wherein $3 \leqq n \leqq 6$, $0 \leqq m \leqq 9$ and $p \geqq 5$; at least one fluorinated saturated or unsaturated ether having the formula $C_aH_bO_cF_d$, wherein $3 \leqq a \leqq 6$, $0 \leqq b \leqq 9$, $c \geqq 1$, and $d \geqq 5$; methylal; at least one simple alcohol; and optionally at least one propellant. In a preferred embodiment, the composition comprises trans-1,2-dichloroethylene, methylal, methyl nonafluorobutyl ether, ethyl nonafluoroisobutyl ether and carbon dioxide. The cleaning compositions are environmentally friendly (non-ozone depleting), are strong enough to tackle tough soils yet mild enough for use on plastic components, are non-flammable, have no flash point, and leave no residue on the substrate.

23 Claims, No Drawings

CLEANER FOR ELECTRONIC PARTS AND METHOD FOR USING THE SAME

BACKGROUND OF THE INVENTION

Precision cleaning is a term used to describe the removal of soil from sensitive electrical and electronic components. For example, electrical, telecommunication and electronic components, including switches, circuits, boards, etc., are often cleaned during their manufacturing process in order to ensure proper electrical conductivity of these components. In addition, during repair and maintenance situations, it is often desirable to perform spot cleaning of electrical and electronic parts.

Ten years ago, the exclusive material for such precision cleaning applications was 1,1,2-trichloro,1,2,2-trifluoroethane, also known as CFC-1 13, which is marketed by E. I.du Pont Nemours & Co. under the trademark Freon TF®, by Allied Signal under the trademark Genesolv D® and by Imperial Chemical Industries under the trademark Arklone P®. However, in 1996 CFC-113 was phased out due to its ozone-depleting characteristics, forcing the development of alternative products. Numerous alternatives have been developed because not one single product has been able to duplicate all of the characteristics of CFC-113.

During the past ten years, a subset of the precision cleaning category has emerged. In particular, in some precision cleaning applications, the soil, which may include grease, sludge and oil, is very heavy and tenacious. It has been found that most CFC-113 alternative products are ineffective on these types of soils. Therefore, HCFC-141b became widely accepted as the product of choice for cleaning grease-like soils from electrical and electronic components. HCFC-141b was a preferred cleaner because it is strong enough to attack heavy soil, yet is gentle enough that it will not damage some sensitive plastics. In addition, 141b is nonflammable and evaporates quickly. The only disadvantage is that it is an ozone-depleting chemical. Consequently, the manufacture of 141b will cease at the end of 2002. Therefore, there remains a need in the art for an environmentally friendly precision cleaner which is strong enough to destroy heavy soil, yet mild enough for use on plastic components.

The application of precision cleaners during manufacturing of the electrical/electronic components may be performed in a cleaning machine, such as a vapor degreaser or cleaning tank. In contrast, often after an electrical or electronic component becomes part of a larger machine, it is no longer possible to clean it using a vapor degreaser or cleaning machine. Therefore, when performing spot cleaning during repair and maintenance situations, aerosol cans are often preferred by maintenance technicians because they are portable, and the aerosol stream may be easily directed to a specific area on the substrate. All propellants are not equivalent and the choice of a proper propellant depends on a given cleaner and a particular situation.

A further desirable feature of a precision cleaning product is that it leave no residue on the substrate. Not only might residue interfere with the performance of the electrical or electronic component, but it could also damage the component.

Consequently, a desirable precision cleaner would be a non-ozone depleting, non-flammable composition which would be applicable as an aerosol, would leave no residue, and would be strong enough to tackle tenacious soil, while at the same time being gentle enough for use on plastic substrates.

BRIEF SUMMARY OF THE INVENTION

According to the present invention, a cleaning composition which meets the above objectives comprises a blend of:

(a) at least one halogenated, saturated or unsaturated hydrocarbon other than cis-1,2-dichloroethylene;

(b) at least one fluorinated, saturated or unsaturated hydrocarbon having the formula $C_nH_mF_p$, wherein $3 \leqq n \leqq 6$, $0 \leqq m \geqq 9$ and $p \geqq 5$;

(c) at least one fluorinated, saturated or unsaturated ether having the formula $C_aH_bO_cF_d$, wherein $3 \leqq a \leqq 6$, $0 \leqq b \leqq 9$, $c \geqq 1$, and $d \geqq 5$;

(d) methylal; and (e) at least one simple alcohol.

According to a preferred embodiment of the invention, an aerosol cleaning composition comprises a blend of about 40 to about 70 weight percent trans-1,2-dichloroethylene, about 20 to about 55 weight percent 1,1,1,3,3-pentafluorobutane, greater than 0 percent but not more than about 20 weight percent methyl nonafluorobutyl ether, greater than 0 percent but not more than about 20 weight percent ethyl nonafluoroisobutyl ether, greater than 0 percent but not more than about 5 weight percent methylal, about 3 to about 8 weight percent carbon dioxide, and greater than 0 percent but not more than about 5 weight percent isopropanol.

According to the present invention, a method for cleaning a substrate, particularly an electronic or electrical component, having a soiled surface comprises applying to the surface one of the above cleaning compositions and removing the composition from the surface, along with the soil.

DETAILED DESCRIPTION OF THE INVENTION

The cleaning compositions according to the present invention are particularly useful for precision cleaning of electronic and electrical components, and in particular for spot cleaning during repair and maintenance situations. As will be described in further detail below, a preferred embodiment of the invention is directed to aerosol cleaning compositions, which are advantageous because they are portable and easy to direct to a specific area. Further, the cleaning compositions according to the present invention are effective on heavy soil such as grease, sludge and oil, yet usable on plastics, leave no residues and are non-ozone depleting.

The compositions are non-aqueous and comprise five essential components as follows: (a) at least one halogenated saturated or unsaturated hydrocarbon; (b) at least one fluorinated saturated or unsaturated hydrocarbon; (c) at least one saturated or unsaturated fluorinated ether; (d) methylal; and (e) at least one simple alcohol. The compositions may optionally comprise a propellant for aerosol application.

The halogenated saturated or unsaturated hydrocarbon preferably has low PEL (personal exposure limit, established by OSHA) and TLV (threshold limit value, established by American Conference of Governmental Industrial Hygienists (ACGIH)), good cleaning ability, and is non-flammable. The halogenated saturated or unsaturated hydrocarbon is preferably trans-1,2-dichloroethylene, trichloroethylene, perchloroethylene or n-propyl bromide, and more preferably is 1,2-trans-dichloroethylene, because its inclusion results in a cleaning composition with desirable cleaning properties, as will be explained in further detail below. However, other halogenated saturated or unsaturated hydrocarbons, either branched or linear, which contain chlorine, fluorine, bromine, or iodine are also within the scope of the invention, as well as halogenated hydrocarbons containing oxygen and/or nitrogen heteroatoms. However, 1,2-cis-dichloroethylene is not an appropriate halogenated hydrocarbon for the cleaning composition. The halogenated hydrocarbon is preferably present in an amount of about 40 to about 70 weight percent of the total weight of the composition, and more preferably about 53 to about 62 weight percent.

The second essential component of the cleaning compositions is a fluorinated hydrocarbon having the formula $C_nH_mF_p$, wherein $3 \leqq n \leqq 6$, $0 \leqq m \leqq 9$ and p is at least 5. The fluorinated hydrocarbon may be branched, linear or cyclic, and may be saturated or unsaturated. Although perfluorinated hydrocarbons are within the scope of the invention, they are not preferred because they may have high global warming potential (GWP). Preferred fluorinated hydrocarbons include 1,1,1,3,3-pentafluoropropane and 1,1,1,2,3,4,4,5,5,5-decafluoropentane. A more preferred compound is 1,1,1,3,3-pentafluorobutane, which has a more desirable boiling point. The fluorinated hydrocarbon compound is preferably present in an amount of about 20 to about 55 weight percent of the total weight of the composition, and more preferably about 25 to about 50 weight percent.

The compositions also contain at least one saturated or unsaturated fluorinated ether having the formula $C_aH_bO_cF_d$, wherein $3 \leqq a \leqq 6$, $0 \leqq b \leqq 9$, c is $\geqq 1$ and d is at least 5. The fluorinated ether may be linear, branched or cyclic. Although monoethers are preferred, ethers containing more than one oxygen atom are also within the scope of the invention. The fluorinated ether is preferably present in an amount of greater than 0 but not more than about 20 weight percent of the total weight of the composition, and more preferably about 6 to about 16 weight percent.

In a preferred embodiment, the compositions comprise two different fluorinated ethers. For example, a preferred composition comprises methyl nonafluorobutyl ether (CAS No. 163702-07-6) in an amount greater than 0 but not more than about 20 weight percent of the total weight of the composition, and preferably about 1 to about 10 weight percent. A second preferred fluorinated ether, ethyl nonafluoroisobutyl ether (CAS No. 163702-08-7), is preferably present in an amount greater than 0 but not more than about 20 weight percent of the total weight of the composition, preferably about 5 to about 15 weight percent. Methyl nonafluorobutyl ether and ethyl nonafluoroisobutyl ether are preferred because they have desirable high boiling points and are compatible with plastics. Both compounds are commercially available from 3M (Saint Paul, Minn.).

The fourth essential component, methylal, also known as dimethoxymethane, is an acetal with CAS No. 109-87-5. Methylal is available from several commercial supply houses, including Aldrich Chemical Company (Milwaukee, Wis.) and Lambiotte et Cie (Brussels, Belgium). It is preferred to use high-grade methylal with moisture content less than 500 ppm in the inventive cleaning composition. Methylal is preferably present in the composition in an amount of greater than 0 but not more than about 5 weight percent of the total weight of the composition, and preferably not more than about 2 weight percent. While not wishing to be bound by theory, it is believed that the methylal functions to clean specific soils such as oxides and other ionic or polar contaminants. It has also been found that the inclusion of methylal serves to brighten the surfaces of shiny metal substrates such as aluminum and steel by removing oxidation from the surface.

The simple alcohol for use in the compositions may be branched or linear and preferably has about 1 to 5 carbon atoms, and more preferably about 3 or 4 carbon atoms. For example, isopropanol is preferred because it exhibits a desirable evaporation rate. Methanol, ethanol, n-propanol, n-butanol, sec-butanol, t-butanol and isobutanol are also alcohols which may be included in the cleaning composition, but some are less preferred due to a tendency to leave behind trace deposits. It is believed that the alcohol aids in removing ionic and polar contaminants from the substrate due to the presence of the —OH groups. The alcohol is preferably present in the composition in an amount of greater than 0 percent, but not more than about 7 weight percent, and preferably not more than about 5 weight percent of the total weight of the composition.

In a preferred embodiment, there is only one type of alcohol present in the composition in order to maintain the non-flammability and desired hygroscopic nature of the composition. For example, a preferred composition contains isopropanol in an amount of greater than 0 percent but not more than about 5 weight percent, preferably not more than about 1 weight percent based on the total weight of the composition. However, it is also within the scope of the invention to include additional alcohol(s) in the composition.

The preferred compositions additionally comprise a sixth component, a propellant for aerosol spraying, which is preferably present in an amount of about 3 to about 8 weight percent of the total weight of the composition, and more preferably about 4 to about 7 weight percent. All propellants are not equivalent and the choice of a propellant in a composition is determined by the components as well as its use; in some situations, certain types of propellants are less attractive in the inventive composition. The most preferred propellant is carbon dioxide due to its solubility in the fluorinated and preferred chlorinated components in the cleaning composition. Other compressed gases, such as nitrous oxide and nitrogen, may also be used as the propellant in the inventive cleaning compositions. However, these compressed gases may have the disadvantages of being more expensive and difficult to handle.

Although liquefied gases, such as HFC-134a, HFC-152a and hydrocarbons are commonly used propellants, they are less desirable as propellants for use in the inventive compositions for several reasons. Such chemicals may be costly, which is undesirable from a practical point of view, or may be flammable and/or chilling. Specifically, it has been found that liquefied propellants, such as 134a and 152a, actually have a negative effect on the performance of the cleaning composition. Unlike compressed gases, such as carbon dioxide, nitrogen, and nitrous oxide, liquefied propellants cause the soil and substrate to become very cold, making the soil more difficult to remove. A cleaner applied at room temperature is better able to penetrate the soil, and the substrate will also release the soil more easily at room temperature than at a colder temperature. Since the boiling points of 134a and 152a are near −20° F., the chilling effect may be significant.

In addition to having a detrimental effect on cleaning performance, chilling the soil and substrate may cause condensation to form on the surface of the soil and substrate, which further interferes with cleaning. Further, water droplets may also remain on the electrical or electronic component long after the cleaner has evaporated. These droplets may interfere with the performance of the components, or may even cause damage to the component. In the inventive composition, therefore, compressed gases are preferred propellants, and carbon dioxide is the most preferred.

The inclusion of a propellant in the cleaning compositions allows them to be applied as an aerosol, which may be attractive when the precision cleaner is used for spot cleaning, for example. However, the precision cleaning composition may also be used during manufacturing, for example, and will also be effective at cleaning tenacious soils from substrates when no propellant is included.

In addition to the essential components, the cleaning compositions of the invention may include additional components such as, but not limited to, perfluorocarbons, which function to suppress flammability but which may have high GWP, as well as aldehydes, ketones and/or glycol ethers.

A preferred cleaning composition of the invention comprises a blend of about 40 to 70 weight percent trans-1,2-dichloroethylene, about 20 to about 55 weight percent 1,1,1,3,3-pentafluorobutane, greater than 0 percent but not more than about 20 weight percent methyl nonafluorobutyl ether, greater than 0 percent but not more than about 20 weight percent ethyl nonafluoroisobutyl ether, greater than 0 percent but not more than about 5 weight percent methylal, about 3 to about 8 weight percent carbon dioxide, and greater than 0 percent but not more than about 5 weight percent isopropanol.

The cleaning compositions according to the present invention are mixtures of azeotropes. Each non-propellant component forms an azeotrope with at least one other component in the mixture. Additionally, the compositions exhibit "azeotrope-like" behavior because the boiling points of the compositions are lower than the boiling points of each of the individual non-propellant components.

The compositions may be prepared simply by combining the desired ingredients and blending or mixing, preferably at room temperature or below. The order of addition, rate of stirring, etc. are not particularly critical. Because some of the components are flammable, care should be taken to perform the mixing in a NFPA30 compliant room. To minimize losses due to evaporation, it is preferred that the mixing be performed in an enclosed pressure vessel equipped with a nitrogen blanket.

The cleaning compositions are preferably packaged in aerosol cans. As previously explained, the inventive precision cleaning compositions may be used advantageously for the industrial repair and maintenance market, and thus it is desirable that the finished product be packaged in a container that is convenient to transport and use. An aerosol can fulfils both of these requirements. Technologies for producing aerosol cans of a cleaning composition are well known in the art and need not be repeated here. As previously explained, it is desirable to select a proper propellant to maximize the cleaning ability of the cleaning composition, which in the present invention is preferably a compressed gas, more preferably carbon dioxide. Aspects of the aerosol can, such as the lining, are not critical. However, it is preferred that the gasket(s) for the aerosol valve be compatible with the products' components. When packaged as aerosols, the inventive compositions have been found to be stable for long periods of time, and weight loss over time has been found to be in a range that is acceptable to those skilled in the art.

The cleaning composition is intended to be used as an industrial precision cleaner, such as for cleaning electrical and electronic articles such as printed circuit boards, magnetic media, disk drive heads, avionics, and the like. However, the cleaning compositions would also be capable of being used for cleaning electronic or electrical components during manufacturing, as general purpose degreasers or in other cleaning applications contemplated by one skilled in the art.

Test Methods

A variety of methods may be used to determine the physical properties and cleaning potentials of candidate cleaning compositions. For example, a common measure of cleaning strength or ability, particularly for greasy-type soils, is known as the Kauri Butanol (KB) value, which assesses the relative hydrocarbon solvent power of a chemical solvent. Non-aqueous cleaners have KB values in a range of 0 to 150; 0 being a very weak cleaner and 150 being a very strong cleaner having high solvency. As a reference, the KB value of CFC-113 is 31, whereas the KB values of many of the new technology HFE and HFC solvents are in the 5 to 10 range, indicating that they have very low cleaning abilities. Therefore, it has become necessary to add other chemicals to HFEs and HFCs in order to make them viable cleaning products.

As discussed previously, HFC-141b is a common alternative to CFC-113. Because HFC-141b has a KB value of 51, products containing HFC-141b are able to perform cleaning duties that CFC-113 could not. However, the manufacture of HFC-141b will soon be discontinued for environmental reasons, and alternative cleaners will replace it. When developing new cleaning compositions, it is most desirable to achieve a KB value in approximately the 45 to 60 range. If the KB value of a cleaner is too high (greater than about 60), the solvency of the cleaner may damage components made of plastic. On the other hand, compositions having a KB value lower than about 45 may not be effective to clean some soils such as grease, sludge and oil.

The KB value of a candidate composition is determined as follows. 20 grams of standard Kauri Gum solution are weighed into an Erlenmeyer flask. A burette is filled with a control solvent and the control is titrated against the standard gum solution. Two Erlenmeyer flasks are filled with 20 grams of standard Kauri Gum solution. The burette is filled with the candidate composition and the sample is titrated with the gum solution. The titration is then repeated on the second solution and the results are averaged.

One method of measuring the cleaning ability of a composition is known as the Fluorescent Dye Test. The Fluorescent Dye Test is a proprietary method, but similar tests are well known to those skilled in the art. The Fluorescent Dye Test is conducted on spray precision cleaners as follows. Both sides of a steel panel measuring 2.5"×3" (available from the Q Panel Company and commonly called Q Panels) are cleaned with a mild degreaser with a KB value of between 45 and 100. The panel is then wiped with a paper towel to ensure that the surfaces are clean. One or two drops of LP-100 Oil (Exxon Chem., Houston, Tex.) with dye (1% Pylam LX8248 Pylakrome fluorescent yellow dye, commercially available from Pylam Products, Phoenix, Ariz.) are applied, as a representative soil, to one side of the panel and spread evenly using a folded Kimwipe® to leave a very thin, evenly distributed layer of oil on the panel. The panel is then observed under a black light to ensure that one entire surface of the panel is coated with the oil. The coated panels are then placed standing vertically on a flat surface. An aerosol sprayer containing the candidate cleaning composition is positioned so that the tip of the extension tube of the sprayer is about three inches from the surface of the panel. The candidate composition is then sprayed in a steady stream directed to the center of the panel for five seconds. The panel is placed on its side lying flat to dry, and then is qualitatively evaluated under a black light by a panel of individuals to determine the percentage of fluorescent oil that was removed by the aerosol stream hitting the panel. A cleaning percent value is obtained by averaging the determinations made by the panel members.

The ability of a composition to clean soils such as brake soil and moly grease may be assessed as follows. Brake soil is applied to one panel by brushing an even coating of diluted brake soil (carbon black mixed with perchloroethylene) onto a 3"×5" Q-panel until the surface is totally covered. The soiled panel is then hung in a 105° C. oven for 1 hour prior to testing. Moly grease is applied to another panel by rolling an even coating of a 50/50 moly grease/oil mixture onto a 6"×12" steel panel using a grooved spreader bar. The soiled panel is hung on a rack with a bent paper clip prior to testing. Both soiled panels are then tested as follows. The panels are leaned upright in a small tray to catch the excess cleaner. An aerosol can containing the candidate cleaning composition is positioned six inches from the panel, and the cleaner is sprayed for 5 seconds with the spray directed toward the center of the panel. The amount of material drained from the panel is qualitatively evaluated by a trained technician to visually determine the percentage of the soil that is removed.

Three methods which may be used to determine the flammability of a composition include the Flame Extension Test, the Aluminum Dish Quick Flammability Determination, and the Closed Cup Test as described below. Each of these tests is a proprietary method, but similar tests are well known to those skilled in the art.

The Flame Extension Test determines how far the spray from an aerosol will extend a flame when the spray passes through the flame. The test is performed as follows. An aerosol can containing a candidate composition is placed in a 70° F. water bath to equilibrate the contents to a standard temperature. The can containing the candidate composition is then positioned six inches behind the flame source, such that the spray will go through the top third of the flame. The composition is then sprayed for four seconds, and the actual flame extension (the distance the flame projects from the can) is measured using a ruler. Each candidate composition is tested three times and the results are averaged.

The Aluminum Dish Quick Flammability Determination is performed as follows. An aluminum dish has 0.5 grams of the candidate composition dripped into it. Under an exhaust hood, an ignited barbecue lighter is waved over the top of the dish, and the dish is observed for instant flame or flame enhancement. The testing is continued every ten seconds until the sample has completely evaporated. If the flame disappears when the flame source is removed, the candidate composition is non-flammable.

The flash point of a composition may be measured using the Closed Cup Test as follows. A sample of the candidate composition is placed in a cup with a lid, and then heated slowly. Every 2° F., the lid is opened and a flame is passed over the vapor. The flash point is the temperature at which enough vapor has been generated to be ignited by the flame source.

In addition, the flash point of a composition may be determined using the Seta Flash Tester, which is used to measure liquids with a flash point of up to 230° F. The Seta apparatus is cleaned, and 2 mL of the candidate composition are injected into the injection port. The heater is turned on, and the test flame is lit and adjusted to a 4 mm diameter. The test flame is then applied by opening the slide fully and closing it completely over a period of approximately 2.5 seconds. If a comparatively large blue flame appears and spreads itself over the surface of the liquid, the material is considered to have flashed.

Furthermore, cleaning compositions may be evaluated using the Bellcore Stressed Plastic Test (also known as the Bellcore Stress Cracking Procedure) on Lexan® Grade 141 (polycarbonate injection molded bars, available from GE Plastics; 2.5"×0.5"×0.125"), Noryl® Grade SEI (modified polyphenylene ether, available from DuPont, Wilmington, Del.; 2.5"×0.5"×0.125") and Cycolac® Grade T (acrylonitrile-butadiene styrene, available from Meta Spec, San Antonio, Tex.; 2.5"×0.1"×0.125"). Details regarding the Bellcore Stress Cracking Procedure are available from Bell Communications Research, Florham Park, N.J. as test method TR-620-23352-84-3. In essence, a candidate cleaner is applied to a sample of plastic (having a stress applied thereon by heating and then bending the plastic) and the plastic is monitored for cracking and crazing over a 24-hour period. If a candidate composition does not harm the plastic, then it passes the Bellcore Stressed Plastic Test.

Finally, the evaporation times of a cleaning composition may be determined as follows. For a short-term evaporation test (2 drops), a 3"×5" steel Q panel is inverted onto its ungrounded side. Using a disposable pipette, two drops of the candidate cleaner are carefully applied to the panel surface, and the time it takes for the two drops to evaporate is measured. For a longer-term evaporation test (0.5 grams), a small aluminum weighing dish is placed on a balance. 0.5 gram of the candidate cleaner is dripped onto the dish and the evaporation time until the balance reads zero grams is measured.

Results

Cleaning compositions according to the invention can meet a number of criteria that render them well suited for use as a precision cleaner for many industrial settings. For example, it has been found that the KB value of the most preferred cleaning composition of the invention is about 50, which has been achieved essentially by the incorporation of trans-1,2-dichloroethylene into the compositions. Compositions of the invention also have excellent cleaning ability, measured by the Fluorescent Dye Test. A typical value for the cleaning compositions according to the present invention is 95% clean. The cleaning compositions according to the invention are also beneficial when used for the cleaning of brake soil or moly grease. Additionally, evaporation times of the inventive cleaning compositions are also favorable.

The compositions of the invention are also non-flammable according to either the Flame Extension Test or the Aluminum Dish Quick Flammability Determination. The inventive cleaning compositions also do not exhibit a flash point as determined by the Closed Cup Test or the Seta Flash Tester. Specifically, the compositions do not ignite at any temperature when subjected to the conditions of the Closed Cup Test, and no flashing is observed in the Seta Flash Tester. Such results are surprising since one might predict that because the liquid portion of the compositions contains approximately 90% flammable components, the entire mixture would be flammable. However, both non-flammability and the absence of a flash point were achieved in the inventive compositions. In conclusion, a wide variety of desirable favorable physical properties are exhibited by the cleaning compositions according to the present invention, which compositions are attractive due to their superb cleaning and environmental friendliness.

The invention will best be understood in conjunction with the following specific, non-limiting examples.

EXAMPLE 1

A cleaning composition was prepared consisting of a blend of 55.6% 1,2-trans-dichloroethylene, 28.0% 1,1,1,3, 3-pentafluorobutane, 3.8% methyl nonafluorobutyl ether, 5.7% ethyl nonafluoroisobutyl ether, 0.95% methylal, 0.95% isopropanol and 5.0% carbon dioxide, all percentages being by weight. The composition was mixed by introducing each component (except the propellant) into a mixing tank, beginning with the largest weight percent component and ending with the smallest weight percent component. The tank was then enclosed and pressurized with nitrogen. After all of the ingredients had been added, the components were mixed in the mixing tank for fifteen minutes at room temperature.

Following mixing, the composition was placed in a standard aerosol container in the following manner, which is well known to those skilled in the art. The liquid composition was transferred from the mixing tank to the filling machine in clean, enclosed piping and the liquid was added to the aerosol can by weighing or metering. The aerosol valve was inserted into the can, crimped onto the can, and a vacuum was applied to extract air from the headspace of the can. The carbon dioxide propellant was then introduced into the can by forcing it through the valve. An alternative method of adding carbon dioxide would be to pump it into the can after inserting the valve but before crimping. After addition of the propellant, the can was passed through a water bath at 130° F. to comply with U.S. Department of Transportation regulations. The composition was then evaluated using the Test Methods described above, and the results are shown in Table 1.

COMPARATIVE EXAMPLE A

Contact Cleaner 2000®, commercially available from CRC Industries, Inc., contains 95% HFC-141b and 5% carbon dioxide propellant. The composition was evaluated using the same Tests Methods, and the data are summarized in Table 1.

COMPARATIVE EXAMPLE B

CO® Contact Cleaner, commercially available from CRC Industries, Inc., is based on hydrofluoroether and hydrofluorocarbon technology and uses a HFC-134a as a propellant. The composition was evaluated using the same Test Methods, and the data are summarized in Table 1.

TABLE 1

Results of Various Tests on Precision Cleaners

| Test | EXAMPLE 1 | COMP. EX A | COMP. EX B |
|---|---|---|---|
| KB value | 50 | 51 | 6 |
| Density (specific gravity) | 1.234 | 1.248 | 1.527 |
| Evaporation (sec) | | | |
| 2 drops | 6 | 28 | 45 |
| 0.5 g | 210 | 175 | 335 |
| Bellcores: | | | |
| Noryl ® | Fail | Fail | Pass |
| Lexan ® | Fail | Fail | Pass |
| ABS | Fail | Fail | Pass |
| Al Dish Flammability | None | None | None |
| Precision Cleaning | 95% | 95% | 10% |
| Moly Grease Cleaning | 90% | 60% | 0 |
| Brake Soil Cleaning | 95% | 50% | 0 |
| Flame Extension | None | None | None |
| Flash Seta | None | None | None |

As can be seen from the data in Table 1, the composition prepared according to the present invention exhibited a KB value (50) comparable to that of comparative Example A (a commercial cleaner based on HFC-141b), and more favorable than the composition prepared according to Comparative Example B (a cleaner using HFC-134a as a propellant). Additionally, the inventive composition exhibited comparable or superior precision, moly grease and brake soil cleaning relative to the comparative compositions. The composition according to the present invention further is non-flammable, has no flash point, has favorable evaporation times and, very significantly, is non-ozone depleting, unlike comparative Example A, which contains HFC-141b. The precision cleaning compositions according to the present invention thus fulfill a long-felt need in the art for strong, versatile cleaners with favorable environmental characteristics.

In addition to providing a cleaning composition with favorable properties, the invention also provides a method for cleaning a soiled surface of a substrate, such as an electronic or electrical component. However, the method would be appropriate for cleaning the soiled surface of any type of substrate. The method comprises applying to the surface a cleaning composition comprising at least one halogenated, saturated or unsaturated hydrocarbon other than cis-1,2-dichloroethylene; at least one fluorinated, saturated or unsaturated hydrocarbon having the formula $C_nH_nF_p$ wherein $3 \leqq n \leqq 6$, $0 \leqq m \leqq 9$ and $p \geqq 5$; at least one fluorinated saturated or unsaturated ether having the formula $C_aH_bO_cF_d$, wherein $3 \leqq a \leqq 6$, $0 \leqq b \leqq 9$, $c \geqq 1$, and $d \geqq 5$; methylal; and at least one simple alcohol; and removing the composition with the soil from the surface.

The compositions may be applied to the surface in a variety of ways. In a preferred embodiment, the composition comprises a propellant and the cleaner is sprayed onto the surface as an aerosol. However, other methods of application known in the art would also be applicable. For example, the cleaner may be sprayed onto the surface from a trigger bottle or pump sprayer, brushed, applied or swabbed onto the surface using an applicator (such as a cotton swab) which had been dipped into the cleaner, or the substrate itself may be dipped or immersed into the cleaning composition, such as in an ultrasonic bath or cleaning machine. Following application of the composition to the soiled surface, it may be desirable to brush or wipe the surface to assist in cleaning, especially if the soil is excessive. Such wiping would be effective to enhance penetration of the soil by the cleaner.

Finally, the cleaner (along with the soil) is removed from the surface, either by wiping it away, such as with a cloth or other material, or by letting the cleaner run off into a pan or other collection device. Under some circumstances, such as when the soil is very heavy or tenacious, it may be desirable to apply a large excess of the cleaner to the surface and allow it to run off. Although it would be possible to simply allow the cleaner to evaporate, this method of removal might cause undesirable re-depositing of the soils on the surface. An advantage of the cleaning composition is that no rinsing of the surface is required, because no residue remains after cleaning with the inventive composition.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A cleaning composition comprising a blend of:

(a) at least one halogenated, saturated or unsaturated hydrocarbon other than cis-1,2-dichloroethylene;

(b) at least one fluorinated saturated or unsaturated hydrocarbon having the formula $C_nH_mF_p$, wherein $3 \leqq n \leqq 6$, $0 \leqq m \leqq 9$ and $p \geqq 5$;

(c) at least one fluorinated saturated or unsaturated ether having the formula $C_aH_bO_cF_d$, wherein $3 \leqq a \leqq 6$, $0 \leqq b \leqq 9$, $c \geqq 1$, and $\geqq 5$;

(d) methylal; and (e) at least one simple alcohol.

2. The cleaning composition according to claim 1, wherein the halogenated hydrocarbon comprises about 40 to about 70 weight percent of the composition; the fluorinated hydrocarbon comprises about 20 to about 55 weight percent of the composition; the fluorinated ether comprises greater than 0 percent but not more than about 20 weight percent of the composition; methylal comprises greater than 0 percent but not more than about 5 weight percent of the composition; and the alcohol comprises greater than 0 percent but not more than about 7 weight percent of the composition.

3. The cleaning composition according to claim 1, wherein the halogenated hydrocarbon is selected from the group consisting of trans-1,2-dichloroethylene, trichloroethylene, perchloroethylene or n-propyl bromide.

4. The cleaning composition according to claim 1, wherein the fluorinated hydrocarbon is selected from the group consisting of 1,1,1,3,3-pentafluorobutane, 1,1,1,3,3-pentafluoropropane and 1,1,1,2,3,4,4,5,5,5-decafluoropentane.

5. The cleaning composition according to claim 1, wherein the fluorinated ether is selected from the group consisting of methyl nonafluorobutyl ether and ethyl nonafluoroisobutyl ether.

6. The cleaning composition according to claim 1, wherein the alcohol is selected from the group consisting of methanol, ethanol, n-propanol, isopropanol, n-butanol, sec-butanol, and t-butanol.

7. The cleaning composition according to claim 6, wherein the alcohol comprises isopropanol.

8. The composition according to claim 1, further comprising a propellant.

9. The cleaning composition according to claim 8, wherein the halogenated hydrocarbon comprises about 40 to about 70 weight percent of the composition; the fluorinated hydrocarbon comprises about 20 to about 55 weight percent of the composition; the fluorinated ether comprises greater than 0 percent but not more than about 20 weight percent of the composition; methylal comprises greater than 0 percent but not more than about 5 weight percent of the composition; the alcohol comprises greater than 0 percent but not more than about 7 weight percent of the composition; and the propellant comprises about 3 to about 8 weight percent of the composition.

10. The cleaning composition according to claim 8, wherein the propellant is selected from the group consisting of a compressed gas and a liquefied gas.

11. The cleaning composition according to claim 10, wherein the compressed gas is selected from the group consisting of nitrous oxide and nitrogen.

12. The cleaning composition according to claim 10, wherein the compressed gas comprises carbon dioxide.

13. The cleaning composition according to claim 10, wherein the liquefied gas is selected from the group consisting of HFC-134a, HFC-152a and hydrocarbons.

14. The cleaning composition according to claim 1, which passes a Seta flash test.

15. The cleaning composition according to claim 1, which is non-flammable.

16. The cleaning composition according to claim 1, which has a Kauri Butanol value of about 45 to about 60.

17. An aerosol cleaning composition comprising a blend of about 40 to about 70 weight percent trans-1,2-dichloroethylene, about 20 to about 55 weight percent 1,1,1,3,3-pentafluorobutane, greater than 0 percent but not more than about 20 weight percent methyl nonafluorobutyl ether, greater than 0 percent but not more than about 20 weight percent ethyl nonafluoroisobutyl ether, greater than 0 percent but not more than about 5 weight percent methylal, about 3 to about 8 weight percent carbon dioxide, and greater than 0 percent but not more than about 5 weight percent isopropanol.

18. A method of cleaning a substrate having a soiled surface comprising:

(a) applying to the surface a cleaning composition comprising:

(i) at least one halogenated, saturated or unsaturated hydrocarbon other than cis-1,2-dichloroethylene;

(ii) at least one fluorinated, saturated or unsaturated hydrocarbon having the formula $C_nH_mF_p$, wherein $3 \leqq n \leqq 6$, $0 \leqq m \leqq 9$ and $p \geqq 5$;

(iii) at least one fluorinated, saturated or unsaturated ether having the formula $C_aH_bO_cF_d$, wherein $3 \leqq a \leqq 6$, $0 \leqq b \leqq 9$, $c \geqq 1$, and $\geqq 5$;

(iv) methylal; and (v) at least one simple alcohol, and (b) removing the composition with the soil from the surface.

19. The method according to claim 18, wherein the substrate is selected from the group consisting of electronic and electrical components.

20. The method according to claim 18, wherein step (a) comprises spraying or swabbing the cleaning composition onto the surface.

21. The method according to claim 18, wherein step (a) comprises dipping or immersing the substrate in the cleaning composition.

22. The method according to claim 18, further comprising brushing or wiping the cleaning composition on the surface before step (b).

23. The method according to claim 18, wherein the composition comprises a blend of about 40 to about 70 weight percent trans-1,2-dichloroethylene, about 20 to about 55 weight percent 1,1,1,3,3-pentafluorobutane, greater than 0 percent but not more than about 20 weight percent methyl nonafluorobutyl ether, greater than 0 percent but not more than about 20 weight percent ethyl nonafluoroisobutyl ether, greater than 0 percent but not more than about 5 weight percent methylal, about 3 to about 8 weight percent carbon dioxide, and greater than 0 percent but not more than about 5 weight percent isopropanol.

* * * * *